US009409229B2

(12) United States Patent
Watanabe et al.

(10) Patent No.: US 9,409,229 B2
(45) Date of Patent: Aug. 9, 2016

(54) METHOD FOR CONTINUOUSLY CASTING SLAB

(71) Applicant: NIPPON STEEL & SUMITOMO METAL CORPORATION, Tokyo (JP)

(72) Inventors: Shinsuke Watanabe, Nogata (JP); Toshihiko Murakami, Kashima (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/892,234

(22) PCT Filed: Jun. 18, 2014

(86) PCT No.: PCT/JP2014/066180

§ 371 (c)(1),
(2) Date: Nov. 19, 2015

(87) PCT Pub. No.: WO2014/203937

PCT Pub. Date: Dec. 24, 2014

(65) Prior Publication Data

US 2016/0096219 A1 Apr. 7, 2016

(30) Foreign Application Priority Data

Jun. 20, 2013 (JP) ..... 2013-129089

(51) Int. Cl.
*B22D 11/128* (2006.01)
*B22D 11/00* (2006.01)
(Continued)

(52) U.S. Cl.
CPC ..... *B22D 11/001* (2013.01); *B22D 11/00* (2013.01); *B22D 11/04* (2013.01); *B22D 11/041* (2013.01); *B22D 11/1206* (2013.01); *B22D 11/1282* (2013.01); *B22D 11/1287* (2013.01);
(Continued)

(58) Field of Classification Search
CPC .. B22D 11/04; B22D 11/1206; B22D 11/128; B22D 11/1282; B22D 11/143; B22D 11/208; B21B 1/46
USPC ..... 164/441, 442, 448, 462, 476, 484
See application file for complete search history.

(56) References Cited

U.S. PATENT DOCUMENTS 3,491,823 A * 1/1970 Tarmann ..... B21B 1/026 164/476
5,497,821 A * 3/1996 Arvedi ..... B22D 11/1206 164/417

(Continued)

FOREIGN PATENT DOCUMENTS

JP 03198964 A * 8/1991
JP 10146651 A * 6/1998

(Continued)

*Primary Examiner* — Kevin E Yoon
(74) *Attorney, Agent, or Firm* — Clark & Brody

(57) ABSTRACT

A main purpose of the present invention is to provide a continuous casting method for a slab satisfying reductions of center segregation and center porosity, and inhibitions of surface cracks and internal cracks of a slab. The method includes a step of carrying out reduction on a slab having an unsolidified part by horizontal rolls and a step of alternatively carrying out reduction on the slab completely solidified by horizontal rolls and vertical rolls, wherein in the former step, reduction ratio of the slab is more than 0.5% and no more than 3% and a ratio of a width of the unsolidified part at the cross section of the slab to a width of a contact part of the slab and the rolls is 0 to 7.15, and in the latter step, each reduction ratio of the slab by the rolls is 5.4% to 6.8%.

8 Claims, 4 Drawing Sheets

(51) Int. Cl.

| | |
|---|---|
| ***B22D 11/04*** | (2006.01) |
| ***B22D 11/12*** | (2006.01) |
| ***B22D 11/20*** | (2006.01) |
| ***B22D 11/041*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/18*** | (2006.01) |

(52) U.S. Cl.

CPC ..... *B22D11/208* (2013.01); *C22C 38/001* (2013.01); *C22C 38/002* (2013.01); *C22C 38/02* (2013.01); *C22C 38/04* (2013.01); *C22C 38/06* (2013.01); *C22C 38/18* (2013.01)

(56) References Cited

U.S. PATENT DOCUMENTS 5,832,984 A * 11/1998 Pleschiut-schnigg ..... B22D 11/1206 164/417

6,491,771 B1 * 12/2002 von Hagen ..... B22D 11/12 148/541

FOREIGN PATENT DOCUMENTS

JP 2000-190058 7/2000

JP 2000288704 A * 10/2000

* cited by examiner

METHOD FOR CONTINUOUSLY CASTING SLAB

TECHNICAL FIELD

The present invention relates to a method for continuously casting a slab used as a material of a high-grade steel bar product, and specifically relates to a method for continuously casting a slab achieving both decreases of center segregation and center porosity and inhibitions of internal cracks and surfaces cracks.

BACKGROUND ART

Generally, a high-grade steel bar product is manufactured by blooming a continuously cast slab having a large rectangular cross section (a so-called bloom) to make a steel billet, and further rolling the billet to make a steel bar product or a wire product. Continuously cast slabs sometimes have defects such as center segregation and center porosity at a final stage of solidification. If the slabs to be materials of high-grade steel bar products have such defects, the properties of the high-grade steel bar products degrade. Therefore, it is important to make such defects not appear in the slabs in continuously casting.

As typical methods of decreasing center segregation and center porosity, a method of carrying out reduction on a slab in a state of having an unsolidified portion inside (hereinafter sometimes referred to as "rolling reduction method in unsolidified state") and a method of carrying out reduction on a slab completely solidified to the inside (hereinafter sometimes referred to as "rolling reduction method after complete solidification"). According to the rolling reduction method in unsolidified state, it is possible to decrease center segregation, since molten steel in which segregation elements which form an unsolidified portion inside the slab are condensed can be discharged to the upstream side of the casting direction. In addition, according to the rolling reduction method in unsolidified state and the rolling reduction method after complete solidification, it is possible to bond by press and decrease center porosity.

In order to decrease center segregation and center porosity of a slab having a rectangular cross section (hereinafter sometimes referred to as "rectangular slab") by carrying out reduction on the slab by means of simple cylindrical rolls (hereinafter sometimes referred to as "flat rolls"), a large reduction amount is required to increase the reduction penetration degree to the central part of the slab. Here, the term "reduction penetration degree" refers to the level of concentration of reduction to the central part of the slab. The larger the reduction penetration degree is, the larger the ratio of the deformation amount of the central part of the slab in the reducing direction to the deformation amount of the surface layer part is. According to the difference in the temperature and deformation resistance between the surface layer and the central part in the reducing direction of the slab, the actual reduction amount of the surface layer part of the slab is different from the actual reduction amount of the central part in the reducing direction. The reduction penetration degree also differs depending on the temperature and deformation resistance.

However, if the reduction amount is large, the possibility of the occurrence of internal cracks of the slab increases especially when the slab is reduced in an unsolidified state, and cracks also tend to occur on a non-reduction surface, as shown in FIG. 1 described below. Therefore, there is a problem of having a high possibility that the properties and quality of steel bar products are impaired.

FIG. 1 is a view showing a state of occurrence of cracks on a non-reduction surface in a case where a rectangular slab is reduced by flat rolls. In a case where a rectangular slab 100 is reduced by the flat rolls 101 with the rolling reduction method in unsolidified state or the rolling reduction method after complete solidification, a reduction stress occurs over the entire reduction surface of the rectangular slab 100 and a buckling deformation occurs on the non-reduction surface, whereby a short side part of the slab projects. Therefore, the reduction penetration degree decreases. Further, a tensile strain occurs on the non-reduction surface due to the projecting deformation of the short side part of the slab. In a case where the reduction amount is large, sometimes a crack 102 in the casting direction occurs on the non-reduction surface of the rectangular slab 100, originated from the tensile strain of the surface of the slab.

Against the problem, Patent Literature 1 suggests a method of increasing the reduction penetration degree of an unsolidified portion of a rectangular slab, by reducing only a part of the slab facing the unsolidified portion at a predetermined reduction ratio by means of convex rolls, to increase the reduction penetration degree of the unsolidified portion. The convex roll includes a convex part having a large diameter locally provided for a central part in the width direction of a flat roll.

CITATION LIST

Patent Literature

Patent Literature 1: JP 2000-190058 A

SUMMARY OF INVENTION

Technical Problem

According to the method suggested in Patent Literature 1, it is possible to obtain a high reduction penetration degree with a less reduction amount compared to a case where flat rolls are used. However, the inventors of the present invention carried out researches and found that: in a case where the slab is reduced by the convex rolls, a distortion occurs when the surface of the slab has a concave shape by the convex part of the rolls, which may create cracks on the surface of the slab.

As described above, it is important to decrease center segregation and center porosity of a slab to be a material, in view of improving the properties and quality of a high-grade steel bar product. Further, it is also important to inhibit occurrences of surface cracks and internal cracks in reduction. However, a continuously casting technique satisfying all of them including improvement in productivity has not been established.

The present invention is made with consideration of these problems. An object of the present invention is to provide a method for continuously casting a slab having an excellent internal quality and surface quality, which satisfies decreases of center segregation and center porosity and inhibitions of surface cracks and internal cracks of a slab and is applicable to various kinds of steels to be used for high-grade steel bar products.

Solution to Problem

The inventors of the present invention researched for a method for manufacturing a slab suitable for a high-grade steel bar product, the method using flat rolls and satisfying decreases of center segregation and center porosity and inhibitions of surface cracks and internal cracks.

In order to make a slab have a quality suitable for a high-grade steel bar product, enlarging the cross-sectional area of the slab is an effective way. This is because, by having a large cross-sectional area, productivity improves, whereby it is possible to decrease the casting speed in a continuous casting apparatus. By decreasing the casting speed, isometric crystals effective to decrease center segregation are easily formed, and inclusions in the molten steel floats and separates to be easily removed.

However, the larger the cross-sectional area of the slab is, the larger the amount of solidification shrinkage is. Therefore, in order to decrease center segregation with the rolling reduction method in unsolidified state, the reduction amount of the slab needs to be larger as the cross-sectional area is larger. Thus, with the rolling reduction method in unsolidified state, the larger the cross-sectional area of the slab is, the easier internal cracks of the slab originated from the surface distortion in accordance with the reduction having a large reduction amount occur.

In addition, in order to inhibit occurrence of center segregation and center porosity of the slab, the reduction penetration degree needs to be high. However, as described above, in order to increase the reduction penetration degree with flat rolls, the reduction amount needs to be large, with consideration of the buckling deformation part of the slab. Then, the possibility of occurrence of internal cracks of the slab increases and cracks can occur on the non-reduction surface.

Further, if the slab has a buckling deformation in a case where the reduction method in unsolidified state is applied, the slab deforms in a manner to outspread in a direction vertical to the reducing direction (the width direction of the slab when the reduction is carried out in the thickness direction of the slab. See FIG. 1). If the slab has a buckling deformation, the unsolidified portion at the central part of the slab also deforms in a manner to outspread in the width direction of the slab. Therefore, if the bucking deformation occurs, the action of discharging the molten steel in which segregation elements are condensed to the upstream side of the casting direction gets decreased. Thus, the molten steel in which segregation elements are condensed is not sufficiently discharged to the upstream side of the casting direction, and center segregation cannot sufficiently decrease even if the rolling reduction method in unsolidified state is applied.

As an ideal reduction method of a slab, a method of reducing only the unsolidified portion at the central part of a slab without causing a buckling deformation can be given. According to the method of using convex rolls described in Patent Literature 1, it is possible to locally reducing a part corresponding to the unsolidified portion. However, as described above, in a case where this method is applied, a distortion having a concave shape is made on the reduction surface of the slab by the convex part of the rolls, which may create cracks on the surface of the slab.

As a result of intensive researches regarding these problems by the inventors of the present invention, the followings were found: in a case where a slab having a round cross section (hereinafter sometimes referred to as "round slab") is reduced by flat rolls, (1) a nearly same amount of reduction penetration degree can be obtained with a less reduction amount, compared to a case where a rectangular slab is reduced by convex rolls, and (2) the amount of the distortion and deformation of the surface of the slab in reduction is less than that of the rectangular slab, and it is possible to prevent occurrence of surface cracks. This is because, when a round slab is reduced, a reduction stress works concentrating in the ark part of the slab in contact with the flat rolls.

The inventors also found that: when the rolling reduction method in unsolidified state is applied to a round slab by means of flat rolls whose axes are arranged in the horizontal direction (hereinafter sometimes referred to as "horizontal rolls", it is possible to sufficiently decrease the center segregation while preventing internal cracks and surface cracks of the slab, by making a part where the slab is in contact with the flat rolls at a cross section of the slab have a predetermined size in width. This is because: by limiting the width of the part where the slab is in contact with the flat rolls, it is possible to locally reduce the unsolidified portion of the slab, whereby a sufficient reduction penetration degree can be obtained.

Further, the followings were also found: after a pair of parallel surfaces is formed on the round slab with the rolling reduction method in unsolidified state, by applying the rolling reduction method after complete solidification to the slab completely solidified to the inside, by means of a group of rolls in which a pair(s) of horizontal rolls and a pair(s) of flat rolls whose axes are vertically arranged (hereinafter sometimes referred to as "vertical rolls") are alternatively arranged, it is possible to form, on the cross section of the slab, a pair of horizontal surfaces which are vertical to the part of the horizontal surfaces formed on ahead, while preventing occurrence of internal cracks and surface cracks of the slab. That is, it is possible to make the cross section of the slab have a rectangle shape whose corners are rounded (the "rectangle" here includes "regular square". The same is applied hereinafter).

In a case where the slab is reduced only in the same direction as in the rolling reduction method in unsolidified state after the complete solidification, the buckling deformation of the slab causes the cross section of the slab to have a shape largely deformed in a direction vertical to the reducing direction of the slab, which may make the slab after completion of the reduction difficult to handle. However, as described above, by making the cross section of the slab after the completion of the reduction have a rectangular shape of rounded corners by means of the horizontal rolls and vertical rolls, the slab gets easy to be handled.

As a result of further researches, the inventors found that: by applying the rolling reduction method after complete solidification by means of the horizontal rolls and vertical rolls when the temperature of the central part of the slab is higher than that of the surface, it is possible to increase the reduction penetration degree and to bond the center porosity by press, compared to a case where the entire slab has a uniform temperature. This is because the central part of the slab has a smaller deformation resistance than the surface when the temperature of the central part of the slab is higher than the surface.

The present invention has been made on the basis of the above findings. The overview of the present invention is a method for continuously casting a slab including a series of: a step 1 of casting a slab having a round cross section with a casting mold; a step 2 of carrying out reduction on the slab by a plurality of pairs of rolls consisting of cylindrical rolls whose axes are arranged in a horizontal direction until there is no unsolidified portion inside the slab, to form a pair of parallel surfaces on the slab; a step 3 of alternatively carrying out reduction on the slab completely solidified after reduction in the step 2, by a pair of cylindrical horizontal rolls whose axes are arranged in the horizontal direction and a pair of cylindrical vertical rolls whose axes are arranged in a vertical direction, to form a pair of parallel surfaces which are vertical to the pair of parallel surfaces formed in the step 2 on the slab, wherein: in the step 2, a reduction ratio of the slab by each pair of the plurality of pairs of rolls is more than 0.5% and no more than 3% and a ratio of a width of the unsolidified portion on a cross section of the slab at a reduction position of said each pair of rolls to a width of a part of the slab where the rolls have contact is from 0 to 7.15; and in the step 3, each of a reduction ratio of the slab by the horizontal rolls and a reduction ratio of the slab by the vertical rolls is from 5.4% to 6.8%.

In the method for continuously casting a slab, it is preferable that a cross section of an inner wall surface of the casting mold is 400 to 600 mm in diameter.

Further, in the step 3, it is preferable that a central temperature of the slab is higher than a surface temperature by 150° C. or more. It is also preferable that at a completion of the step 3, two pairs of the parallel surfaces have a same interval of 235 to 270 mm.

Advantageous Effect of Invention

The method for continuously casting a slab of the present invention is applicable to various kinds of steels to be used for high-grade steel bar products. According to the method for continuously casting a slab of the present invention, it is possible to manufacture a slab having a large cross section suitable for a high-grade steel bar product by means of flat rolls, the slab easy for handling, not having center segregation, center porosity, internal cracks, or surface cracks.

DESCRIPTION OF EMBODIMENTS

1. Basic Structure of Continuous Casting Apparatus

Figure 1:
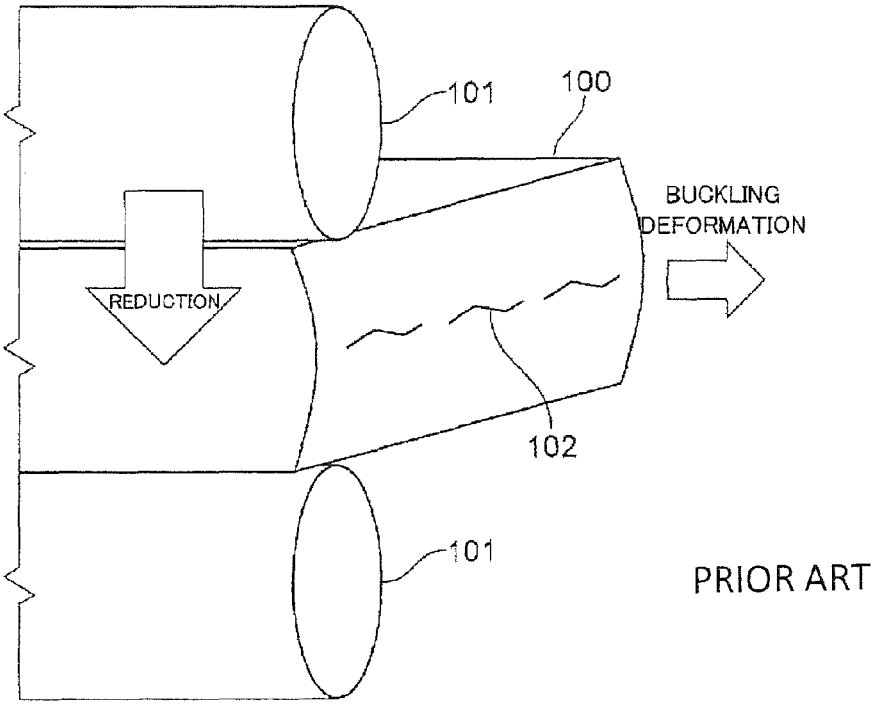
FIG. 1 is a view showing a state of occurrence of cracks at a non-reduction surface of a rectangular slab, where the slab is reduced by flat rolls.
Figure 2:
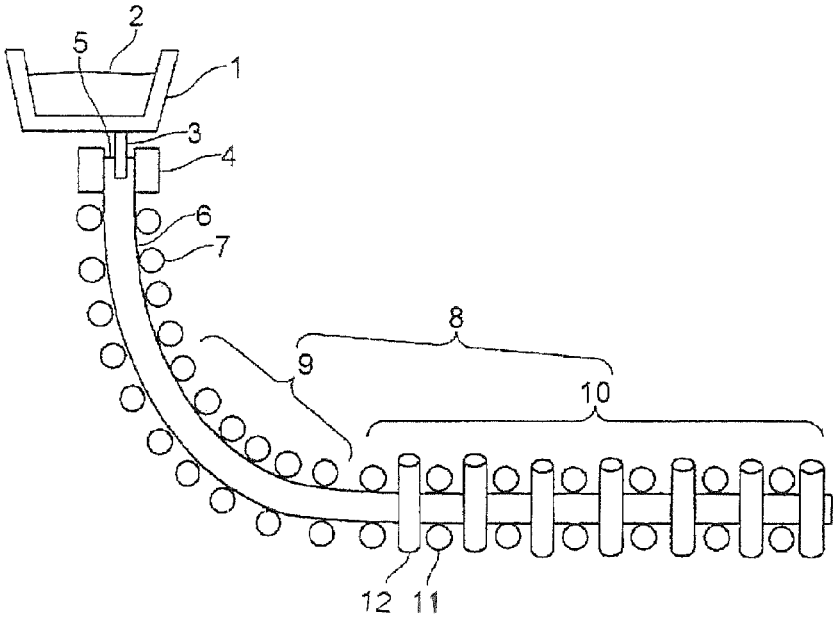
FIG. 2 is a view to show an example of a structure of a continuous casting apparatus which can apply the method for continuously casting a slab of the present invention.
Figure 3:
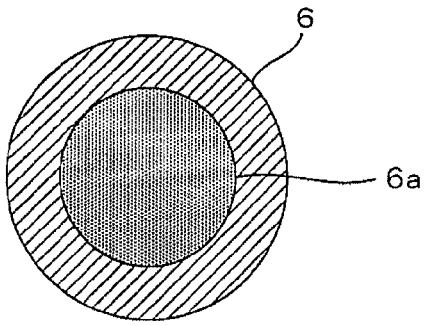
FIG. 3 is a view to explain a slab 6 to be manufactured by the step 1.

FIG. 2 is a view to show an example of a structure of a continuous casting apparatus which can apply the continuous casting method of the present invention. To a tundish 1, a molten steel 2 is supplied from a ladle which is not shown. The molten steel 2 pours into a casting mold 4 from the tundish 1 via an submerged nozzle 3, to form a meniscus 5, then secondary cooled by cooling water sprayed from a group of secondary cooling spray nozzles arranged to the casting mold 4 and under the casting mold 4, which are not shown, to form a solidified shell to be a slab 6. FIG. 3 shows a simplified cross section of the slab 6.

The slab 6 is, supported by a plurality of guide rolls 7 while having an unsolidified portion inside, extracted by a group of pairs of reduction rolls 8 arranged on the downstream side in the casting direction of the guide rolls 7, and reduced.

The group of reduction rolls 8 includes: pairs of reduction rolls 9 in unsolidified state which carry out multi-stage reduction to the slab 6 in a state of having an unsolidified part inside, until there is no unsolidified portion inside the slab; and reduction rolls 10 after complete solidification arranged following the reduction rolls 9 in unsolidified state and which carry out reduction on the slab 6 completely solidified to the inside. The reduction rolls 9 in unsolidified state are formed by a plurality of pairs of rolls whose axes are arranged in the horizontal direction (horizontal rolls). The reduction rolls 10 after complete solidification are formed by a pair (s) of horizontal rolls 11 whose axes are arranged in the horizontal direction and a pair(s) of vertical rolls 12 whose axes are arranged in the vertical direction. The pair of horizontal rolls 11 and the pair of horizontal rolls 12 are alternatively arranged. The rolls which form the group of reduction rolls 8 are all simple cylindrical rolls, that are, flat rolls.

2. Method for Continuously Casting Slab of the Present Invention

In the continuous casting method of the present invention, a casting mold having no bottom, whose inner wall surface has a round cross section, is used as the casting mold 4, to cast the slab 6 having a round cross section (step 1).

Figure 4:
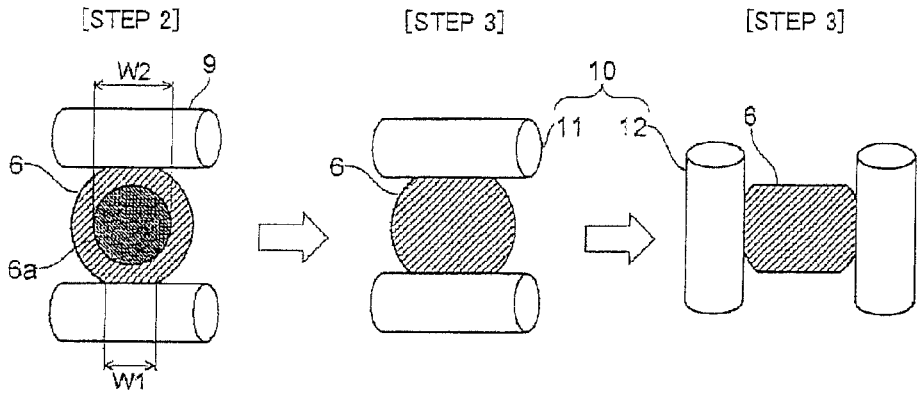
FIG. 4 is a schematic view to show changes in the shape of a slab by reduction by means of a group of reduction rolls.

FIG. 4 is a schematic view to show changes in the shape of a slab by reduction by means of a group of reduction rolls. The slab 6 cast in the step 1 having a round cross section is, as described in FIG. 4, subjected to multi-stage reduction by means of the reduction rolls 9 in unsolidified state, until there is no unsolidified portion 6*a* inside the slab 6, to form a pair of parallel surfaces. At this time, a width W2 in the horizontal direction of the unsolidified portion 6*a* at a cross section of the slab 6, the width W2 at the reduction point by each of the reduction rolls 9 in unsolidified state, is made to be 0 to 7.15 times as a width W1 of a contacting part of the slab 6 with the reduction rolls 9 in unsolidified state. That is, the ratio W2/W1 (hereinafter sometimes referred to as "contact ratio") of the width W2 of the unsolidified portion of the slab to the width W1 of the contacting part is made to be 0 to 7.15 (step 2, rolling reduction method in unsolidified state). The value of the width W2 of the unsolidified portion of the slab can be obtained on the basis of a value preliminarily measured by means of a pin method. In the step 2 for inhibiting suction of condensed molten steel around the central part of the slab, a soft reduction by a plurality of rolls is required to the unsolidified portion inside the slab deformed in an ellipse due to the formation of a pair of parallel surfaces by a soft reduction, in order to continuously inhibit the suction of condensed molten steel. Here, the followings are reasons that the parallel surfaces are limited to one pair: it is more effective to further thin the unsolidified portion deformed into an ellipse by the prior soft reduction, for the inhibition of the suction of the condensed molten steel; and in order to prevent occurrence of internal cracks. In a case where two pairs of parallel surfaces are formed by reduction in the vertical direction and horizontal direction, the amount of soft reduction at each stage gets large, which may cause occurrence of internal cracks due to the soft reduction at the unsolidified portion.

After the pair of parallel surfaces is formed in the step 2, the slab 6 completely solidified to the inside is reduced by the reduction rolls 10 after complete solidification. That is, as shown in FIG. 4, by carrying out reduction on the slab 6 by the horizontal rolls 11 in the same direction as the reducing direction of the reduction rolls 9 in unsolidified state, the width of the pair of horizontal surfaces formed by the reduction rolls 9 in unsolidified state is enlarged. Further, by carrying out reduction on the slab 6 by the vertical rolls 12 in the vertical direction to the reducing direction of the horizontal rolls 11, a pair of parallel surfaces vertical to the pair of parallel surfaces enlarged by the horizontal rolls 11 is formed. Thereafter, a series of reduction from the horizontal direction and the vertical direction by the horizontal rolls 11 and the vertical rolls 12 are repeated in plural times (step 3, rolling reduction method after complete solidification). As a result, the cross section of the slab 6 has a rectangle shape having rounded corners.

The method for continuously casting a slab of the present invention is a method including a series of the above steps 1 to 3.

The slab obtained by the continuous casting method of the present invention does not have center segregation, center porosity, internal cracks, or surface cracks, but has a good internal property and surface property. Further, since the cross section of the slab is rectangle having rounded corners, it is easy to handle the slab compared to round slabs. In addition, the effect of the present invention can be obtained even by applying the present invention to any kind of steel such as a carbon steel and an alloy steel.

The reduction ratio of the slab in the step 2 by each roll of the reduction rolls in unsolidified state is more than 0.5% and no more than 3.0%. The reduction ratio of the slab in the step 2 means the ratio of reduction amount of each roll in the thickness direction of the slab to the thickness of the slab before the reduction.

The reason for setting the above range is: if the reduction ratio is 0.5% or less, it might not be able to sufficiently reduce the slab, therefore it is difficult to inhibit the occurrence of center segregation; and if the reduction ratio is more than 3.0%, an excessive reduction amount is applied to the slab, which increases the possibility of occurrence of internal cracks of the slab and surface cracks of the non-reduction surface. The reduction ratio is preferably more than 0.5% and no more than 2.5%. The reduction amount in carrying out reduction on the slab by each pair of rolls can be set by adequately setting the reduction taper in the step 2, by controlling roll intervals in the reducing direction for each pair of rolls.

It is preferable that two to six pairs of the reduction rolls in unsolidified state are used in the step 2.

In a case where the rolling reduction method in unsolidified state is applied in the step 2, the contact ratio W2/W1 is set as 0 to 7.15 (see FIG. 4). If the reduction ratio is excessively large at a position where the center solid phase ratio of the unsolidified portion 6*a* (ratio of solid phase at the central part of the slab) is 0.3 to 0.8, internal cracks occur to the slab, and if the reduction ratio is insufficient, center segregation occurs. Therefore, the purpose of setting the contact ratio W2/W1 as 0 to 7.15 is to make the reduction ratio in an adequate range to prevent these defects.

When W2/W1 is more than 7.15, the center solid phase ratio is low, which is in a preliminary stage of suction of condensed molten steel. Therefore, a soft reduction is not required yet. In addition, when W2/W1 is 0, the unsolidified portion inside the slab is completely zero, which means the slab is in a complete solidification state. Therefore, the soft reduction to the slab at this stage does not affect the inhibition of center segregation. That is, it is effective that the soft reduction amount by each roll is controlled so that the soft reduction is carried out until W2/W1 linearly changes from 7.15 to 0. This is because it is possible to unambiguously obtain the length of a part of the slab where the slab has contact with soft reduction rolls, by controlling the soft reduction amount to the slab having a round cross section.

It is preferable that the continuous casting method of the present invention has the following configuration.

It is preferable that the cross section of the inner wall surface of the casting mold used in the step 1 is 400 to 600 mm in diameter, due to following reasons.

In order to sufficiently discharge the molten steel having condensed segregation elements to the upper stream side in the casting direction, for inhibiting the occurrence of center segregation by the reduction method in unsolidified state, the unsolidified portion of the slab needs to be reduced in a wide range. However, the smaller the cross-sectional area of the slab to be obtained by the casting is, the easier the slab is cooled to the central part. Therefore, the distance from the meniscus in the casting mold to the position where the slab completely solidifies (hereinafter the distance is referred to as "length of the unsolidified portion") gets short. Specifically, if the diameter of the inner wall surface of the casting mold is less than 400 mm, the length of the unsolidified portion is too short to sufficiently discharge the molten steel having condensed segregation elements to the upstream side in the casting direction. Further, the smaller the diameter of the inner wall surface of the casting mold is, the more the number of strands needs to be increased to secure the productivity of slabs. Therefore, an enormous cost is required for the continuous casting apparatus. Therefore, it is preferable that the diameter of the inner wall surface of the casting mold is 400 mm or more.

On the other hand, if the diameter of the inner wall surface of the casting mold is more than 600 mm, the position where the slab completely solidifies will be at a position farther than the length of a normal continuous casting apparatus, which makes it difficult to apply the reduction method after complete solidification in the step 3, whereby it becomes difficult to bond by press and decrease center porosity. In order to make the rolling reduction method after complete solidification applicable and make it possible for slabs to be reduced to sizes with which blooming can be omitted, the length of the continuous casting apparatus needs to be very long. Therefore, an enormous cost is required for the continuous casting apparatus. Therefore, it is preferable that the diameter of the inner wall surface of the casting mold is 600 mm or less.

For the above reasons, the inner wall surface of the casting mold is preferably 400 to 600 mm in diameter. The diameter is more preferably 400 to 460 mm. In a case where the diameter of the inner wall surface of the casting mold is in these ranges, it is easy to decrease the casting speed to the preferable range below (0.35 to 0.65 m/min) since the productivity of the slab is high.

In the continuous casting method of the present invention, the casting speed is preferably 0.30 to 0.65 m/min. If the casting speed is less than 0.30 m/min, there is a high possibility for the slab to completely solidify to the inside before the slab reaches the reduction rolls in unsolidified state, whereby it might not be able to apply the rolling reduction method in unsolidified state in the step 2. In addition, when the slab is reduced by the reduction rolls after complete solidification in the step 3, there is a possibility that the reduction penetration degree gets low whereby center porosity is not sufficiently bonded by press, since the temperature difference of the central part and the surface of the slab gets small to make the difference between the deformation resistance of the central part and the deformation resistance of the surface of the slab small.

On the other hand, if the casting speed is more than 0.65 m/min, there is a high possibility that the position where the slab completely solidifies will be at a position farther than the length of a normal continuous casting apparatus. As a result, it becomes difficult to apply the reduction method after complete solidification of the step 3, which makes it difficult to bond by press and decrease center porosity.

For the above reason, the casting speed is preferably 0.30 to 0.65 m/min. If the casting speed is in this range, isometric crystals are easily generated, whereby it is possible to further decrease center segregation. In addition, it is easy to float and remove inclusions in the molten steel, which results in a further improvement of the quality of the slab. The casting speed is more preferably 0.35 to 0.60 m/min.

In the continuous casting method of the present invention, the specific water amount in secondary cooling of the slab is preferably 0.10 to 0.55 L/kg-steel. This is because: if the specific water amount is less than 0.10 L/kg-steel, it is difficult to sufficiently cool a predetermined part of the slab while sustaining sprays of cooling water in a predetermined shape. If the specific water amount is more than 0.55 L/kg-steel, the cooling intensity of the slab gets excessively locally large. At the part where the cooling intensity is excessively large, the temperature difference when the slab is cooled and when the slab is recuperated is large, which might cause surface cracks. The specific water amount in secondary cooling is more preferably 0.15 to 0.20 L/kg-steel.

In the step 3 (rolling reduction method after complete solidification) of the present invention, the reduction ratios of the slab by the horizontal rolls and by the vertical rolls are each 5.4% to 6.8%. Hereinafter the reduction ratio of the slab in the step 3, unless otherwise mentioned, means: regarding the horizontal rolls, the ratio of the reduction amount in the thickness direction of the slab by each of the horizontal rolls to the thickness in the thickness direction of the slab before reduction; and regarding the vertical rolls, the ratio of the reduction amount in the width direction of the slab by each of the vertical rolls to the width in the width direction of the slab before reduction.

The reason of having the reduction ratio of the slab in the step 3 within the range 5.4% to 6.8% is: if the reduction ratio is less than 5.4%, the slab is not sufficiently reduced, whereby it is difficult to bond by press and decrease center porosity. On the other hand, if the reduction ratio is more than 6.8%, the reduction ratio of the slab is excessively large, whereby surface cracks occur on the slab. The surface cracks include cracks originated from the buckling deformation caused by reduction.

The reduction rolls after complete solidification used in the step 3 can be one group formed by a pair of the horizontal rolls and a pair of vertical rolls adjacent each other, but two to seven groups are preferable.

In the step 3, it is preferable that the reduction is carried out in a state where the central temperature of the slab is 150° C. or more higher than the surface temperature. In a case where the central temperature of the slab is 150° C. or more higher than the surface temperature, the deformation resistance at the central part of the slab is sufficiently small compared to the deformation resistance of the surface of the slab, whereby it is possible to increase the reduction penetration degree even with a small reduction amount. Therefore, it is possible to more certainly inhibit center segregation and decrease center porosity by press bonding. The state in which the central temperature of the slab is higher than the surface temperature by 150° C. or more can be achieved by efficiently controlling the casting speed and the specific water amount in secondary cooling. In addition, the temperature difference of the central part and the surface can be obtained for example by a central temperature of the slab obtained by a solidification model calculation, on the basis of a surface temperature of the slab measured by a thermo viewer or a radiation thermometer. In the step 3, the temperature difference of the central part and the surface of the slab (central temperature of the slab—surface temperature of the slab) is preferably 500° C. or less.

Further, in the step 3, it is preferable that the two pairs of parallel surfaces of the slab have a same interval of 235 to 270 mm, that is, the cross section of the slab is a regular square having rounded corners whose sides are 235 to 270 mm. The reason is: in the rolling of the slab carried out later to make a billet (whose cross section is a regular square whose sides are 100 to 200 mm or a round whose diameter is 100 to 200 mm), it is possible to omit a conventional blooming step (primary rolling step to make the shape of the cross section of the slab into a regular square whose sides are 235 to 275 mm), therefore it is possible to reduce energy cost required for heating of the slab before rolling.

EXAMPLES

The following casting test was carried out to confirm the effect of the method for continuously casting a slab of the present invention.

(1) Test Condition

For the casting test, the continuous casting apparatus shown in FIG. 2 was used. The reduction rolls in unsolidified state were arranged in a section of 17 to 32 m from the meniscus in the casting mold on the downstream side of the casting direction, and the reduction rolls after complete solidification were arranged in a section of 32 to 45 m from the meniscus on the downstream side of the casting direction. As the reduction rolls in unsolidified state, six pairs of horizontal rolls were arranged, having a roll pitch (distance between the roll pairs adjacent each other in the casting direction) of 1.2 m. As the reduction rolls after complete solidification, one pair of horizontal rolls and one pair of vertical rolls were made as one group, and seven groups were arranged in the casting direction from the upstream side of the casting direction.

The casting speed was 0.30 m/min (test No. 3) or 0.50 m/min (test No. 1 to 2 and 4 to 9). The specific water amount in secondary cooling was 0.20 L/kg-steel. Steels used in the casting test had the chemical composition shown in Table 1.

TABLE 1

| chemical composition (mass %, remnant is Fe and impurities) | | | | | | | |
|---|---|---|---|---|---|---|---|
| C | Si | Mn | P | S | Cr | Al | N |
| 0.72 | 0.27 | 0.73 | 0.016 | 0.010 | 0.09 | 0.024 | 0.0040 |

Table 2 shows each shape of the cross section of the inner wall surface of the casting molds, reduction conditions in the step 2 (rolling reduction method in unsolidified state), and reduction conditions in the step 3 (rolling reduction method after complete solidification) as test conditions. As the reduction conditions in the step 2: the range of reduction ratio by each pair of the reduction rolls in unsolidified state; the range of the ratio (contact ratio, W2/W1) of the width (W2 in FIG. 4) of the unsolidified portion of the slab to the width (W1 in FIG. 4) of the contact part of the slab with the reduction rolls in unsolidified state; and the total reduction ratio by the all reduction rolls in unsolidified state were shown. As the reduction conditions in the step 3, the reduction ratio by each pair of the reduction rolls after complete solidification (horizontal rolls and vertical rolls) and the total reduction ratio by the all horizontal rolls and the all vertical rolls were shown. The interval in reducing direction of each pair of the reduction rolls in unsolidified state was set so as to form a certain amount of reduction taper.

TABLE 2

| test No. | classification | shape of cross section of casting mold | step 2 (roll reduction method in unsolidified state) roll reduction ratio *1 x(%) | roll contact ratio *2 (W2/W1) | total reduction ratio (%) | step 3 (roll reduction method after complete solidification) roll reduction ratio *1 (%) thickness direction | roll reduction ratio *1 (%) width direction | total reduction ratio (%) thickness direction | total reduction ratio (%) width direction | difference between central temperature and surface temperature of slab (° C.) |
|---|---|---|---|---|---|---|---|---|---|---|
| 1 | Example | round | 0.5 < x ≤ 2.0 | 0.0-7.1 | 7.5 | 6.7 | 6.8 | 40.3 | 47.8 | 150 or more |
| 2 | Example | round | 0.8 < x ≤ 1.8 | 0.0-5.6 | 7.8 | 5.4 | 5.7 | 32.2 | 40.0 | 150 or more |
| 3 | Example | round | 0.8 < x ≤ 1.8 | 0.0-5.6 | 7.8 | 5.4 | 5.7 | 32.2 | 40.0 | less than 150 |
| 4 | Comparative Example | round | 0.5 < x ≤ 2.0 | 0.0-7.1 | 7.5 | — | — | — | — | 150 or more |
| 5 | Comparative Example | round | 0.0 < x ≤ 0.3 | 0.0-15.2 | 1.0 | 5.8 | 5.1 | 34.6 | 35.6 | 150 or more |
| 6 | Comparative Example | round | 0.5 < x ≤ 2.0 | 0.0-7.1 | 7.5 | 4.7 | 5.1 | 28.1 | 35.6 | 150 or more |
| 7 | Comparative Example | round | 1.0 < x ≤ 3.0 | 0.0-5.1 | 13.0 | 6.4 | 7.3 | 38.1 | 51.1 | 150 or more |
| 8 | Comparative Example | perpendicular | 0.5 < x ≤ 2.0 | — | 7.5 | — | — | — | — | 150 or more |
| 9 | Comparative Example | perpendicular | 1.0 < x ≤ 3.0 | — | 13.0 | — | — | — | — | 150 or more |

*1 value of reduction ratio by each pair of rolls, or range of reduction ratio (maximum value and minimum value)

*2 range of ratio of width of non-solidified portion to value of contacting part of slab with rolls (maximum value and minimum value)

In the test Nos. 1 to 5, round casting molds each having a cross section of the inner wall surface of 450 mm in diameter were used. In the test Nos. 6 and 7, rectangular casting molds each having a cross section of the inner wall surface of 345 mm in thickness and 460 mm in width were used. The length of each casting mold was 800 mm.

Test Nos. 1 and 2 are examples of the present invention satisfying the conditions defined in the present invention. Test No. 3 is an example in which the casting speed was 0.30 m/min and the difference between the central temperature and the surface temperature of the slab was less than 150° C. Test No. 4 is a comparative example in which the range of the reduction ratio in the step 2 was same as in the test No. 1 but the step 3 (rolling reduction method after complete solidification) was not applied after the step 2 (rolling reduction method in unsolidified state). Test No. 5 is a comparative example in which the maximum value of the range of the contact ratio was larger in the step 2 than the maximum value defined in the present invention and the reduction ratio by each pair of rolls was smaller in the step 3 than the reduction ratio defined in the present invention. Test No. 6 is a comparative example in which the reduction ratio by each pair of rolls was smaller in the step 3 than the reduction ratio defined in the present invention. Test No. 7 is a comparative example in which the reduction ratio by each pair of rolls was larger in the step 3 than the reduction ratio defined in the present invention.

Test Nos. 8 and 9 are comparative examples in which each slab was a rectangular slab and the step 3 was not applied. In test No. 8, the range of the reduction ratio in the step 2 was same as in the test No. 1. In test No. 9, the range of the reduction ratio in the step 2 was higher than that of test No. 8.

(2) Test Result

Table 3 shows results of quality evaluation of obtained slabs, as test results. As the quality evaluation, occurrence states of center segregation, center porosity, internal cracks, and surface cracks on the non-reduction surface were evaluated. The "surface cracks on the non-reduction surface" means surface cracks on the surfaces corresponding to the surfaces of the obtained slabs which did not have contact with the reduction rolls in unsolidified state in the step 2. In Table 3, the results were valued in three scales of 1 to 3, wherein 1 means the slab is at an acceptable level (can be used without limiting product application), 2 means the slab is at an acceptable level if its product application is limited, and 3 means the slab is a rejection level (cannot be used even whatever the product application is).

The center segregation was evaluated by carrying out mirror surface polishing to samples of cross section cut out from the obtained slabs and observing the polished surfaces by etching them with a picric acid solution. As a result of the observation, a slab was considered to be 1 in a case of having a cross section at which the larger width of center segregation generated in the parallel direction to each of the two pairs of parallel surfaces of the slab was less than 3 m. A slab was considered to be 2 in a case of having a cross section at which the larger width of the center segregation was no less than 3 m and less than 10 mm, and was considered to be 3 in a case of having a cross section at which the larger width of the center segregation was 10 mm or more.

The center porosity was evaluated by carrying out ultrasonic flaw detection to the obtained slabs. As a result of the ultrasonic flaw detection, a slab was considered to be 1 in a case where the echo height was less than 20%. It was considered to be 2 in a case where the echo height was no less than 20% and less than 60%, and it was considered to be 3 in a case where the echo height was 60% or more.

Occurrence of the internal cracks was evaluated by carrying out mirror surface polishing to samples of the cross sections cut out from the obtained cast slabs and visually observing the polished surfaces by applying a sulfur print to them. Occurrence of the surface cracks on the non-reduction surface was evaluated by visually observing the non-reduction surfaces (surfaces corresponding to the surfaces which did not have contact with the reduction rolls in unsolidified state) of the obtained slabs.

TABLE 3

| test No. | classification | center cegregation | center porosity | internal cracks | surface cracks*3 |
|---|---|---|---|---|---|
| 1 | Example | 1 | 1 | none | none |
| 2 | Example | 1 | 1 | none | none |
| 3 | Example | 1 | 1 | none | none |
| 4 | Comparative Example | 1 | 2 | none | none |
| 5 | Comparative Example | 2 | 2 | none | none |
| 6 | Comparative Example | 1 | 2 | none | none |

TABLE 3-continued

| test No. | classification | center cegregation | center porosity | internal cracks | surface cracks*3 |
|---|---|---|---|---|---|
| 7 | Comparative Example | 1 | 1 | occurred | occurred |
| 8 | Comparative Example | 2 | 2 | none | none |
| 9 | Comparative Example | 1 | 1 | occurred | occurred |

*3presence or absence of occurrence of surface cracks at non-reduction surface of slab (surface corresponding to surface not having contact with rolls in step 2)

As shown in Table 3, evaluations of the center segregation and the center porosity of the slabs of test Nos. 1 and 2 which were examples of the present invention were 1. Each of the slabs had a good internal quality in which no internal cracks were confirmed, and had a good surface quality on which no surface cracks on the non-reduction surface were confirmed. Test No. 3 in which the difference of the central temperature and the surface temperature of the slab was less than 150° C. had a larger value of the echo height than that of test No. 2. However, the evaluation of the center porosity was 1. The evaluation of the center segregation and center porosity of Test No. 3 kept the acceptable level. Test No. 3 had a good internal quality in which no internal cracks were confirmed, and had a good surface quality on which no surface cracks on the non-reduction surface was confirmed.

The slab of test No. 4 which was a comparative example was considered to be 2 in the evaluation of the center porosity, and had a poor internal quality. It is considered this is because the rolling reduction method after complete solidification of the step 3 was not applied, therefore the center porosity remained. Evaluations of other qualities than the center porosity were considered to be same as in the test No. 1.

The slab of test No. 5 which was a comparative example was considered to be 2 in the evaluation of the center segregation and center porosity, and had a poor internal quality. It is considered that the evaluation of the center segregation was 2 since the contact ratio in the step 2 was large and the reduction amount of the slab in unsolidified state was insufficient. In addition, it is considered that the evaluation of the center porosity was 2 since the reduction ratio after complete solidification in the step 3 was small, therefore the center porosity remained. Internal cracks and surface cracks on the non-reduction surface were not confirmed.

The slab of the test No. 6 which was a comparative example was considered to be 1 in the evaluation of the center segregation but considered to be 2 in the evaluation of the center porosity, and had a poor internal quality. It is considered the evaluation of the center porosity was 2 since the reduction ratio after complete solidification in the step 3 was small, therefore center porosity remained. Internal cracks and surface cracks on the non-reduction surface were not confirmed.

The slab of the test No. 7 which was a comparative example was confirmed to have internal cracks and surface cracks on the non-reduction surface along with the buckling deformation. It is considered this is because the contact ratio in the step 2 was small and the reduction amount of the slab in unsolidified state was excessively large, and because the reduction ratio after complete solidification in the step 3 was excessively large. Evaluation of the center segregation and center porosity were considered to be same as in test No. 1.

The rectangular slab of test No. 8 which was a comparative example was considered to be 2 in the evaluations of the center segregation and center porosity, and had a poorer internal quality compared to the round slab of test No. 1 which had a same reduction ratio. It is considered this is because: the reduction rolls in unsolidified state had contact with the entire width of the rectangular slab whereas the round slab had a narrower width of the part where the slab had contact with the rolls, compared to the rectangular slab; therefore, the rectangular slab had a lower reduction penetration degree than that of the round slab. No internal cracks and surface cracks on the non-reduction surface were confirmed.

The rectangular slab of test No. 9 which was a comparative example was confirmed to have internal cracks and surface cracks on the non-reduction surface. In the test No. 9, the reduction ratio in the step 2 was increased more than that in the test No. 8, in order to increase the reduction penetration degree. It is considered the surface cracks on the non-reduction surface (surface on the shorter side of the rectangular slab) were formed since the reduction amount was excessively large whereby a large distortion was generated at the non-reduction surface of the slab caused by the buckling deformation in reduction. Evaluation of the center segregation and center porosity were considered to be same as in the test No. 1.

INDUSTRIAL APPLICABILITY

The method for continuously casting a slab of the present invention is applicable to various kinds of steels to be used for high-grade steel bar products. According to the method for continuously casting a slab of the present invention, it is possible to manufacture a slab having a large cross section suitable for a high-grade steel bar product, the slab easy for handling, not having center segregation, center porosity, internal cracks, or surface cracks.

REFERENCES SIGN LIST

1 tundish
2 molten steel
3 submerged nozzle
4 casting mold
5 meniscus
6 slab
**6*a*** unsolidified portion
7 guide roll
8 group of reduction rolls
9 reduction roll in unsolidified state
10 reduction roll after complete solidification
11 horizontal roll
12 vertical roll
100 rectangular slab
101 flat roll
102 surface crack

The invention claimed is:

1. A method for continuously casting a slab, the method comprising a series of:

a step 1 of casting a slab having a round cross section with a casting mold;

a step 2 of carrying out reduction on the slab by a plurality of pairs of rolls consisting of cylindrical rolls whose axes are arranged in a horizontal direction until there is no unsolidified portion inside the slab, to form a pair of parallel surfaces on the slab;

a step 3 of carrying out reduction on the slab completely solidified after reduction in the step 2, by using an alternating pair of cylindrical horizontal rolls whose axes are arranged in the horizontal direction and a pair of cylindrical vertical rolls whose axes are arranged in a vertical direction, to form a pair of parallel surfaces which are vertical to the pair of parallel surfaces formed in the step 2 on the slab, wherein:

in the step 2, a reduction ratio of the slab by each pair of the plurality of pairs of rolls is more than 0.5% and no more than 3% and a ratio of a width of the unsolidified portion on a cross section of the slab at a reduction position of said each pair of rolls to a width of a part of the slab where the rolls have contact is from 0 to 7.15; and in the step 3, each of a reduction ratio of the slab by the horizontal rolls and a reduction ratio of the slab by the vertical rolls is from 5.4% to 6.8%.

2. The method for continuously casting a slab according to claim 1, wherein a cross section of an inner wall surface of the casting mold is 400 to 600 mm in diameter.

3. The method for continuously casting a slab according to claim 2, wherein in the step 3, a central temperature of the slab is higher than a surface temperature by 150° C. or more.

4. The method for continuously casting a slab according to claim 3, wherein at a completion of the step 3, two pairs of the parallel surfaces have a same interval of 235 to 270 mm.

5. The method for continuously casting a slab according to claim 2, wherein at a completion of the step 3, two pairs of the parallel surfaces have a same interval of 235 to 270 mm.

6. The method for continuously casting a slab according to claim 1, wherein in the step 3, a central temperature of the slab is higher than a surface temperature by 150° C. or more.

7. The method for continuously casting a slab according to claim 6, wherein at a completion of the step 3, two pairs of the parallel surfaces have a same interval of 235 to 270 mm.

8. The method for continuously casting a slab according to claim 1, wherein at a completion of the step 3, two pairs of the parallel surfaces have a same interval of 235 to 270 mm.

* * * * *